US005509632A

United States Patent [19]

Mesna et al.

[11] Patent Number: 5,509,632

[45] Date of Patent: Apr. 23, 1996

[54] METHODS FOR FORMING HOOK FOR CHAIN LINK FENCE

[76] Inventors: Larry D. Mesna, 32118 Hunsacker Way; Gregory C. Mesna; Wendy L. Mesna, both of P.O. Box 2344, all of Running Springs, Calif. 92382

[21] Appl. No.: 387,573

[22] Filed: Feb. 13, 1995

Related U.S. Application Data

[63] Continuation of Ser. No. 114,786, Aug. 30, 1993.

[51] Int. Cl.[6] ..... A47F 5/00

[52] U.S. Cl. ..... 248/301; 248/304; 248/339

[58] Field of Search ..... 248/215, 301, 248/303, 304–308, 312.1, 227, 211, 207, 294, 290, 339, 340, 220.3, 220.1, 322; 211/60.1, 13; 24/370, 343, 84 B, 369, 363, 360, 907, 716

[56] References Cited

U.S. PATENT DOCUMENTS

| | | | |
|---|---|---|---|
| 1,873,297 | 8/1932 | Davenport | 248/220.3 X |
| 1,899,509 | 2/1933 | Lapin . | |
| 2,589,126 | 3/1952 | Payne | 24/343 |
| 2,622,833 | 12/1952 | Robinson | 248/211 |
| 3,653,624 | 4/1972 | Abel | 248/215 X |
| 3,972,499 | 8/1976 | Simmons | 248/304 X |
| 4,049,126 | 9/1977 | Halverson | 248/303 X |
| 4,518,025 | 5/1985 | Judkins | 248/340 |
| 4,953,817 | 9/1990 | Mosteller | 248/303 X |

FOREIGN PATENT DOCUMENTS

| | | | |
|---|---|---|---|
| 974739 | 9/1975 | Canada | 24/84 B |
| 1096102 | 6/1955 | France | 24/370 |
| 2412291 | 8/1979 | France | 248/221.1 |

*Primary Examiner*—Karen J. Chotkowski

[57] ABSTRACT

A hook for use with a chain link fence where the hook starts as an L-shaped flat metal element and is formed into an integral piece having a first vertically disposed element integral with a second element which is folded relative to the first element along a fold line of 45 degrees so as to be generally parallel but spaced from the first element. A third element is integral with the first element and is folded to extend away from the first element to form an arm for supporting sports equipment or clothing. The 45 degree fold allows the hook to straddle a wire of the fence. Thus, the hook is simply constructed, elegantly formed and easily used.

7 Claims, 3 Drawing Sheets

METHODS FOR FORMING HOOK FOR CHAIN LINK FENCE

This is a continuation of copending application Ser. No. 08/114,786 filed on Aug. 30, 1993 which is still pending.

TECHNICAL FIELD

The present invention relates generally to detachable hooks, and, more particularly, to hooks for use in conjunction with chain link fences and a method for forming such hooks.

BACKGROUND ART

In nearly every kind of sports arena, a common sight is a chain link fence, whether it is a fence surrounding a tennis court, a fence defining a batter's cage, or a fence surrounding the playing field and stands of a Little League baseball park or of a high school football field.

Such fences may be high, such as at tennis courts, or, if low, the top of the fence may terminate in a series of barbs. In neither case is the fence of use for hanging articles, such as gloves, caps, jackets, sports bags, and the like, either due to height of the fence or the possibility of tearing the article.

A desirable article would be a small hook, adapted to be used in conjuction with the fence, that is removable and is easily carried in, for example a sports bag.

DISCLOSURE OF INVENTION

The invention includes a method of forming a hook comprising the steps of providing a generally L-shaped flat metal element, bending the element at the junction of the two arms of the L-shaped element along a fold line disposed at about 45 degrees relative to a vertical or horizontal reference, and bending one of the two arms of the element in a direction opposite that of the first bending step.

The hook of the invention is removably engagable with the wire portion of a chain link fence, and, being small, is easily transportable. The hook may be used to suspend articles such as baseball gloves, caps, jackets, sports bags, and the like. An embodiment is also provided for suspending baseball bats and the like.

BEST MODES FOR CARRYING OUT THE INVENTION

Figure 1:
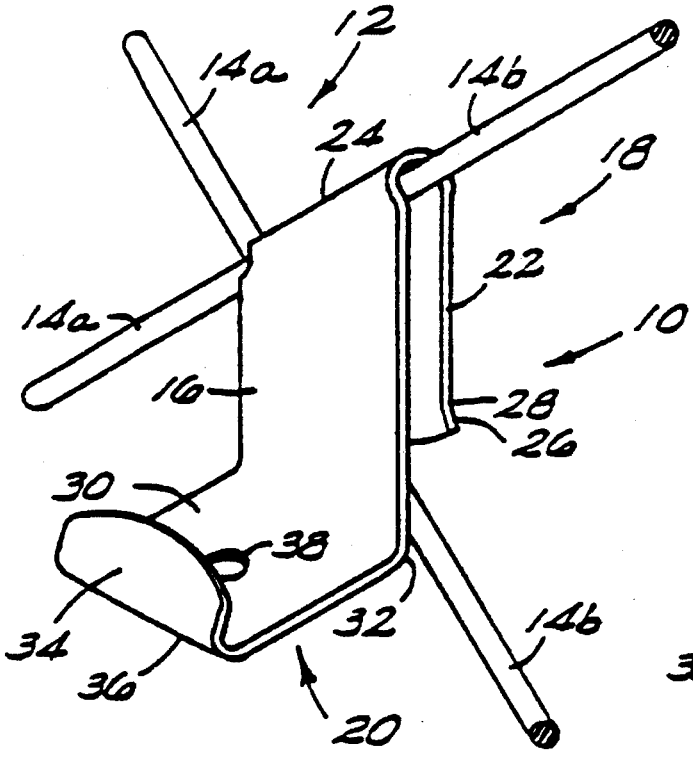
FIG. 1 is a perspective view of a hook in accordance with the invention, showing its use in conjunction with a portion of a chain link fence.

Referring now to the drawings wherein like numerals represent like elements throughout and wherein analogous elements are indicated by a "100" or "200" designation, FIG. 1 depicts one embodiment of the hook 10 of the invention, depicting engagement of the hook on a portion 11 of a chain link fence. As shown in FIG. 1 (and FIGS. 4 and 7), the portion 12 of the chain link fence depicted comprises two intersecting wires 14*a*, 14*b*, which interconnect and loop back at a 45° angle to each other. Such chain link fences are well-known.

The hook 10 of the present invention comprises three portions: a vertically-depending shank portion 16, a first end portion 18, and a second end portion 20

The first end portion 18 comprises a first major flap 22 which is bent over to be substantially parallel to the shank portion 16, along fold line 24 (see also FIG. 3) to form a first hanger means for hanging the hook 10 from the fence 12. The fold line 24 is at 45° to the vertical axis of the shank portion 16. A small minor flap 26 is bent outward from the major flap 22 to assist in engagement of the sports hook 10 with the wire 14 of the chain link fence. Specifically, engagement is to wire, 14*b*, just above the junction at which the two wires 14*a*, 14*b* intersect and are bent back. The minor flap 26 is slightly bent along line 28. This minor flap 26, while of use in engagement, is an advantageous aspect of the invention and not an essential feature.

Figure 2:
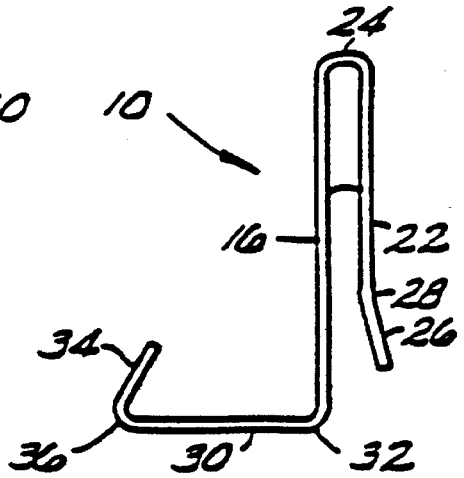
FIG. 2 is a side elevational view of the hook.
Figure 3:
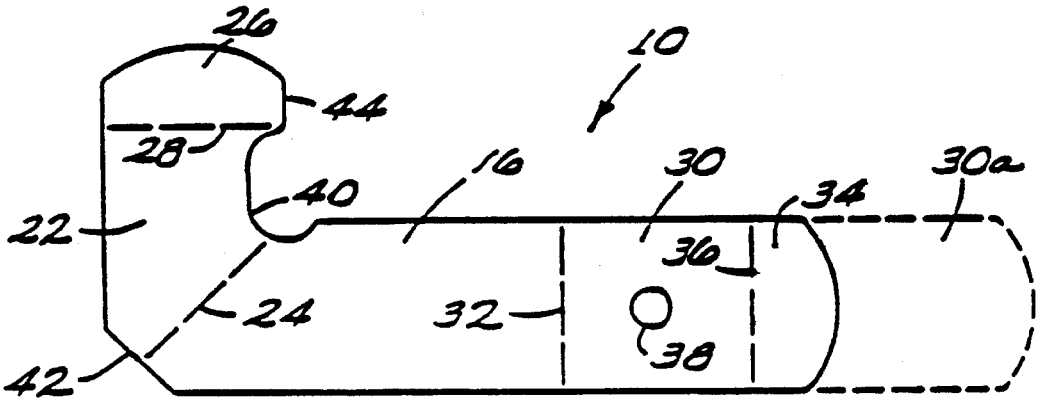
FIG. 3 is a top plan view of the hook of the invention in its pattern state, showing also an alternate embodiment thereof in phantom.

The second end portion 20 comprises a second hanger portion 30 from which articles (not shown) may be suspended when the hook 10 is placed on the wire 14. The second hanger portion 30, in the embodiment depicted in FIGS. 1–3, is bent along line 32 at substantially a 90° angle to the shank portion 16. In this embodiment, a minor flap 34 is bent back toward the shank portion 16 along line 36, at an angle of at least about 90°, to ensure that articles suspended from the hanger portion 30 do not inadvertently fall off.

As an example only, the width of the second hanger portion 30 (from the shank portion 16 to the minor flap 34) may be on the order of 1 inch (2.5 cm) or so. However, as shown in phantom denoted 30*a* in FIG. 3, it may also be longer to accommodate larger articles.

Figure 4:
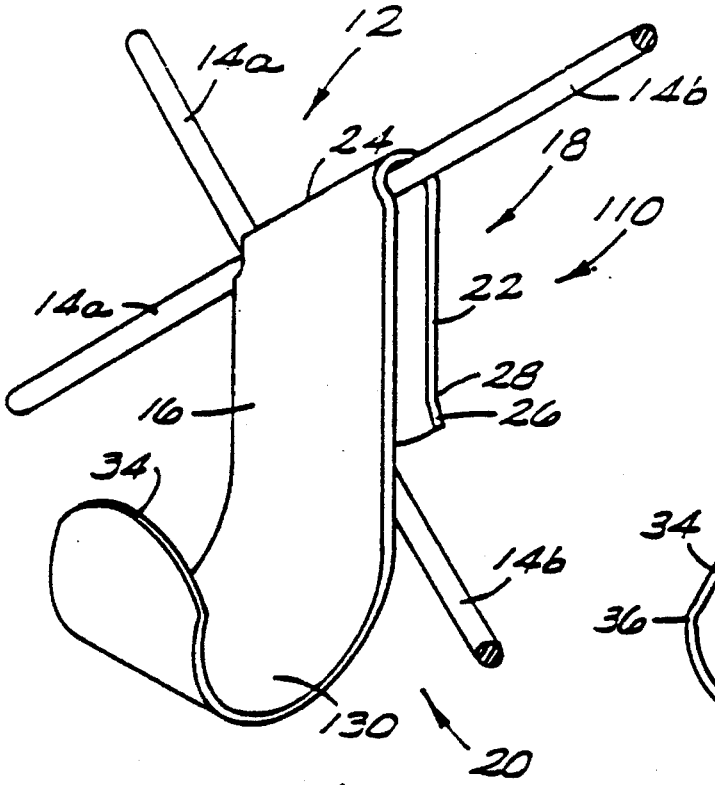
FIG. 4 is a view similar to that of FIG. 1, but illustrating another embodiment of the invention.
Figure 5:
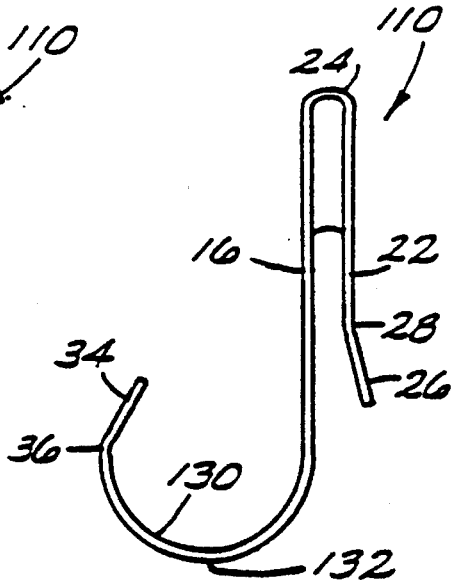
FIG. 5 is a view similar to that of FIG. 2, illustrating the embodiment depicted in FIG. 4.
Figure 6:
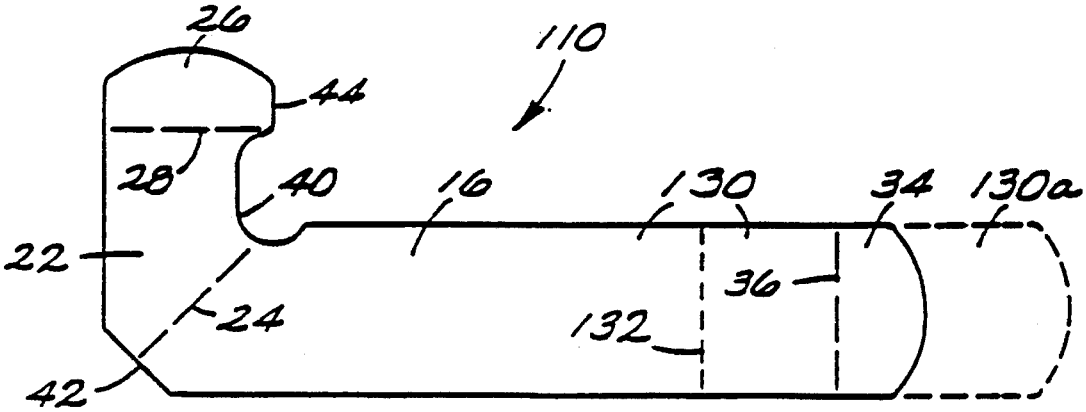
FIG. 6 is a view similar to that of FIG. 3, illustrating the embodiment depicted in FIG. 4 and showing also an alternate embodiment thereof in phantom.

Turning now to FIGS. 4–6, it is seen that the difference between the hook 10 depicted in FIGS. 1–3 and the hook 110 depicted in FIGS. 4–6 is that the second hanger portion 130 comprises a concave hanger instead of a flat hanger. Line 132 is shown, but this is not intended to be a fold line, but rather to depict the approximate location of the bottom portion of the concavity. As in FIG. 3, and as shown in FIG. 6, the second hanger portion 130 may be extended, as shown in phantom denoted 130*a*, so as to provide a deeper or wider concavity.

Figure 7:
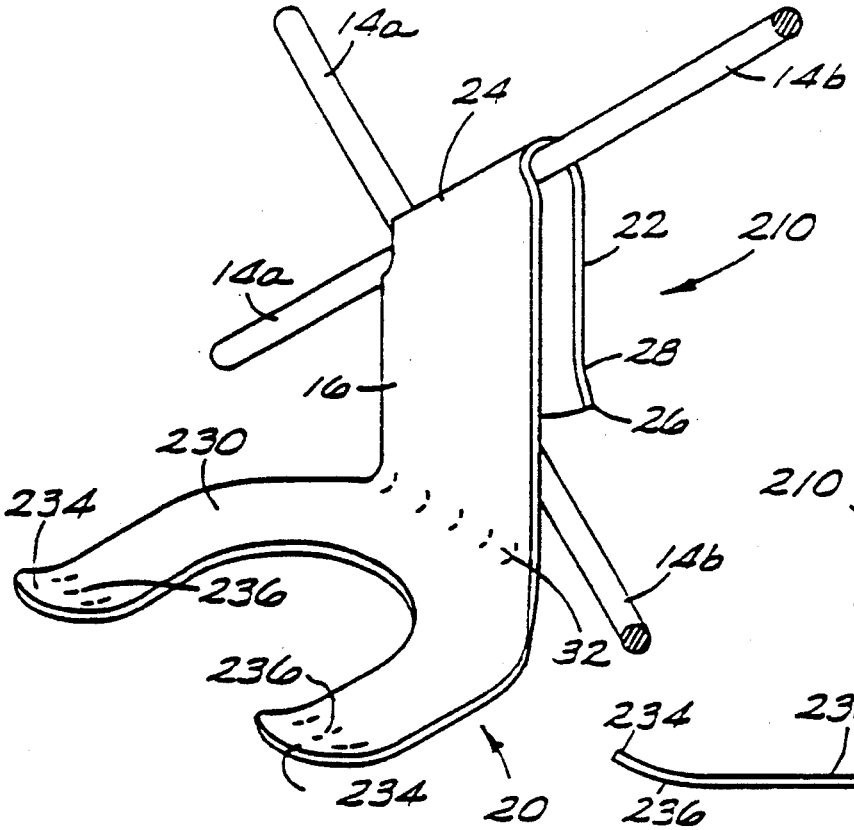
FIG. 7 is a view similar to that of FIG. 1, but illustrating yet another embodiment of the invention.
Figure 8:
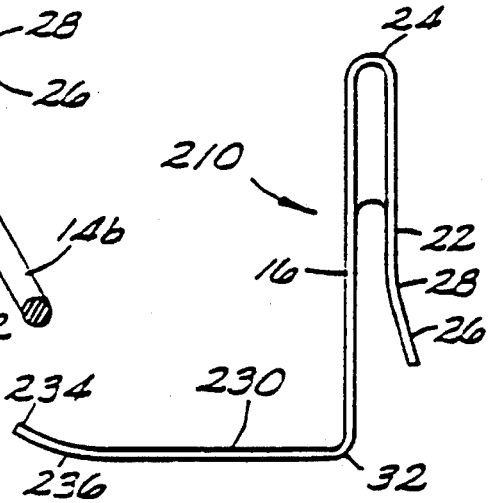
FIG. 8 is a view similar to that of FIG. 2, illustrating the embodiment depicted in FIG. 7.
Figure 9:
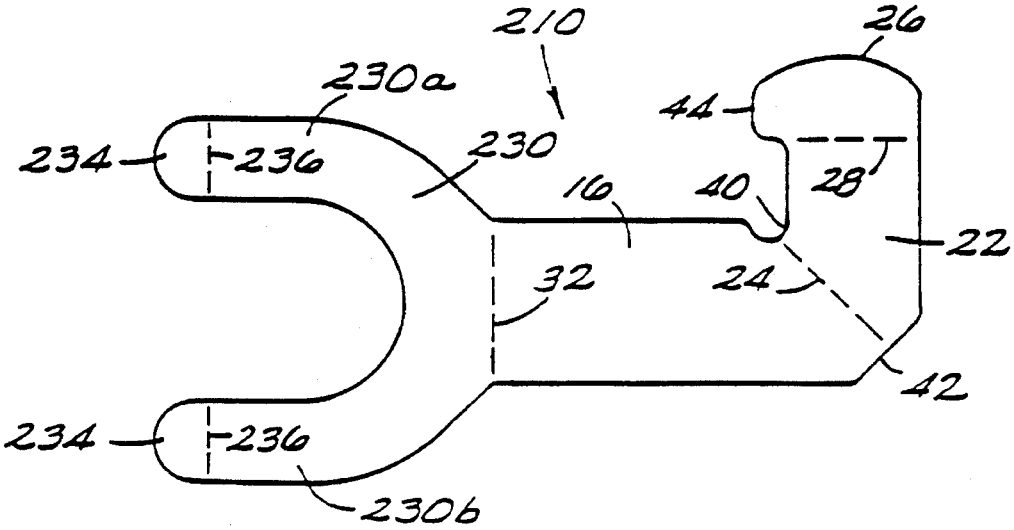
FIG. 9 is a view similar to that of FIG. 3, but without an additional embodiment in phantom, illustrating the embodiment depicted in FIG. 7.

Turning now to FIGS. 7–9, it is seen that the difference between the hook 10 depicted in FIGS. 1–3 and the hook 210 depicted in FIGS. 7–9 is that the second hanger portion 230 includes two prongs 230*a*, 230*b* instead of simply a flat hook. The two prongs 230*a*, 230*b* are sized and spaced apart so as to support a baseball bat (not shown) upside down at its handle. Tabs 234 are not bent back like tabs 34, but rather slightly upward, much like ski tips.

It is anticipated that the hook 10, 110 of the present invention may be used to suspend articles such as baseball gloves, jackets, caps, and the like therefrom. Hook 210 of the present invention may be used to suspend baseball bats and other similarly shaped articles.

A hole 38 is depicted in FIGS. 1 and 3. This hole 38 may be present or absent from any of the embodiments described herein. The function of the hole 38 permits attachment of a sports bag or key chain so as to provide additional security in the attachment.

Similarly, there are indentations 40, 42 as shown particularly in FIGS. 3, 6, and 9. Indentation 40, in combination with tab portion 44, permits engagement with wire 14*b* near its junction with wire 14*a* to provide more stable securement of the hook 10, 120, 210 to the fence 12. Indentations 40 and 42 aid in bending along line 24. Indentation 42 also provides eye .appeal to the sports hook 10, 110, 210 of the invention.

The hook 10, 110, 210 is made from a flat piece of heavy gauge metal, such as cold roll steel and either nickel plated or powder coated, having a thickness of about 1/16 inch (0.16 cm). However, the particular material and its thickness are not critical to the practice of the invention, so long as the hook 10, 110, 210 is rigid enough for its intended purpose. Accordingly, other suitable metals or plastics of suitable strength may be contemplated in the practice of the present invention.

As shown in FIGS. 3, 6, and 9, the flat piece of metal is in essentially the shape of an "L" and is bent along the lines indicated therein, as described in greater detail above, to form it into its final shape. The distance between the shank portion 16 and the first major flap 22 is that sufficient to accommodate the diameter of the wire portion 14 forming the chain link fence. That distance is approximately 3/16 inch (0.48 cm), but may be somewhat larger or smaller to meet its intended use.

The hook 10, 110, 210 of the present invention may be coated with a distinctive color, such as by the well-known powder coating process, for association with a particular professional athletic team for promotional purposes. Alternatively, or additionally, a decal or engravement may be provided on the shank portion 16 facing the suspending hook portion 30, 130, 230 for the same purposes.

INDUSTRIAL APPLICABILITY

The sports hook of the invention is expected to find use for temporarily hanging articles from chain link fences.

Thus, there has been disclosed a hook for temporarily suspending articles from a chain link fence. It will be readily apparent to those skilled in this art that various changes and modifications of an obvious nature may be made without departing from the spirit of the invention, and all such changes and modifications are considered to fall within the scope of the appended claims.

What is claimed is:

1. A hook apparatus adapted to be used on a chain link fence comprising:

a first vertically disposed element having two oppositely located end portions;

a second vertically disposed element integral with first said element and extending from the top one of said two oppositely located end portions of said first element and disposed with said first element in an L-shape before said first and second elements are folded relative to one another and disposed with said first element in a generally parallel configuration after being folded;

said first and second elements being separated by about 3/16 of an inch in their folded disposition;

a rounded fold portion connecting said first and second elements when said first and second elements are in their folded disposition, said fold portion being disposed at approximately 45 degrees relative to a vertical reference;

a third element integral with said other elements and extending away from the bottom one of said two end portions of said first element for supporting an article to be suspended therefrom;

a flap portion integral with said first, second and third elements and extending away from said second element at an acute angle to enhance engagement of a wire portion of the chain link fence with said rounded fold portion after said wire portion passes between said first and second elements; and said elements having a generally constant width except that said rounded fold portion has a reduced width.

2. The hook apparatus as claimed in claim 1 wherein:

said third element comprises a flat portion extending outwardly from said first element at an angle of approximately 90 degrees.

3. A hook apparatus as claimed in claim 2 wherein:

said third element includes a flap at the extended end of said flat portion, said flap being bent back at an angle toward said first element.

4. A hook apparatus as claimed in claim 1 wherein:

said third element comprises a concave portion that downwardly depends from said first element.

5. A hook apparatus as claimed in claim 4 wherein:

said third element includes a flap at the terminus of said concave portion, said flap being bent back in an angle toward said first element.

6. A hook apparatus as claimed in claim 1 wherein:

said third element comprises a flat portion extending outwardly from said first element at an angle of approximately 90 degrees, said flat portion being bifurcated into two prongs.

7. A hook apparatus as claimed in claim 6 wherein:

said third element includes a flap at the end of each of said prongs, said flaps being bent slightly upward.

* * * * *